US008585865B2

(12) United States Patent
Wielema

(10) Patent No.: US 8,585,865 B2
(45) Date of Patent: Nov. 19, 2013

(54) PROCESS FOR MAKING PAPER

(75) Inventor: Thomas Albert Wielema, Groningen (NL)

(73) Assignee: Cooperatie AVEBE U.A., Foxhold (NL)

( * ) Notice: Subject to any disclaimer, the term of this patent is extended or adjusted under 35 U.S.C. 154(b) by 0 days.

(21) Appl. No.: 13/120,469

(22) PCT Filed: Dec. 18, 2009

(86) PCT No.: PCT/NL2009/050782

§ 371 (c)(1), (2), (4) Date: Mar. 23, 2011

(87) PCT Pub. No.: WO2010/071435

PCT Pub. Date: Jun. 24, 2010

(65) Prior Publication Data

US 2011/0186253 A1 Aug. 4, 2011

(30) Foreign Application Priority Data

Dec. 18, 2008 (EP) ..... 08075951

(51) Int. Cl.
*D21H 17/28* (2006.01)

(52) U.S. Cl.
USPC ..... 162/175; 162/146; 162/158; 162/181.1

(58) Field of Classification Search
USPC ..... 162/141, 146, 158, 175, 179, 164.1, 162/164.3, 164.6, 168.1, 181.1
See application file for complete search history.

(56) References Cited

U.S. PATENT DOCUMENTS

| | | | | | |
|---|---|---|---|---|---|
| 3,174,874 | A * | 3/1965 | Fikentscher et al. | ..... | 427/475 |
| 3,940,519 | A * | 2/1976 | Helmer et al. | ..... | 427/395 |
| 4,388,150 | A | 6/1983 | Sunden et al. | | |
| 4,643,801 | A | 2/1987 | Johnson | | |
| 4,663,159 | A * | 5/1987 | Brode et al. | ..... | 424/70.13 |
| 4,687,519 | A * | 8/1987 | Trzasko et al. | ..... | 106/205.1 |
| 4,753,710 | A | 6/1988 | Langley et al. | | |
| 4,913,775 | A | 4/1990 | Langley et al. | | |
| 5,776,476 | A | 7/1998 | Billmers et al. | | |
| 5,993,604 | A * | 11/1999 | Finlayson et al. | ..... | 162/168.1 |
| 6,521,088 | B1 | 2/2003 | Richardson et al. | | |
| 6,767,430 | B1 * | 7/2004 | Wielema et al. | ..... | 162/175 |
| 6,777,548 | B1 * | 8/2004 | Kesselmans et al. | ..... | 536/105 |
| 7,056,419 | B2 * | 6/2006 | Sundaram et al. | ..... | 162/158 |
| 2002/0117278 | A1 * | 8/2002 | Ikeda et al. | ..... | 162/158 |
| 2002/0170693 | A1 * | 11/2002 | Merrette et al. | ..... | 162/175 |
| 2003/0024667 | A1 * | 2/2003 | Wallenius et al. | ..... | 162/109 |
| 2003/0121632 | A1 * | 7/2003 | Nurminen et al. | ..... | 162/158 |
| 2004/0118539 | A1 * | 6/2004 | Sundaram et al. | ..... | 162/158 |
| 2005/0236127 | A1 * | 10/2005 | Neivandt et al. | ..... | 162/175 |
| 2006/0254737 | A1 * | 11/2006 | Anderson et al. | ..... | 162/175 |
| 2007/0074641 | A1 * | 4/2007 | Dyllick-Brenzinger et al. | ..... | 106/215.1 |
| 2008/0314539 | A1 * | 12/2008 | Williams et al. | ..... | 162/164.6 |
| 2009/0017235 | A1 * | 1/2009 | Bays et al. | ..... | 428/32.18 |
| 2010/0155338 | A1 * | 6/2010 | Ladret et al. | ..... | 210/731 |
| 2010/0230063 | A1 * | 9/2010 | Wielema et al. | ..... | 162/175 |
| 2011/0048659 | A1 * | 3/2011 | Beaupre et al. | ..... | 162/164.5 |
| 2011/0186253 | A1 * | 8/2011 | Wielema | ..... | 162/175 |

FOREIGN PATENT DOCUMENTS

| | | | | | |
|---|---|---|---|---|---|
| EP | 0189935 | A2 | 8/1986 | | |
| EP | 0603727 | A1 | 6/1994 | | |
| EP | 0689829 | A2 | 1/1996 | | |
| EP | 1103655 | A1 * | 5/2001 | ..... | D21H 17/28 |
| EP | 1141030 | B1 | 10/2001 | | |
| EP | 1743693 | A1 | 1/2007 | | |
| EP | 1865105 | A1 * | 12/2007 | ..... | D21H 17/29 |
| EP | 2199462 | A1 * | 6/2010 | ..... | D21H 17/28 |
| WO | 9301353 | A1 | 1/1993 | | |
| WO | 9424169 | A1 | 10/1994 | | |
| WO | 9605373 | A1 | 2/1996 | | |
| WO | 9955964 | A1 | 11/1999 | | |
| WO | 9964467 | A1 | 12/1999 | | |
| WO | 2004031478 | A1 | 4/2004 | | |

* cited by examiner

*Primary Examiner* — Jose Fortuna
(74) *Attorney, Agent, or Firm* — Hoffmann & Baron, LLP

(57) ABSTRACT

The invention relates to the field of papermaking. More in particular, the invention relates to the use of a novel dry strength agent in the wet-end of the papermaking process.

11 Claims, No Drawings

PROCESS FOR MAKING PAPER

This application is the U.S. National Phase of, and Applicant claims priority from, International Patent Application Number PCT/NL2009/050782 filed 18 Dec. 2009 and European Patent Application Number 08075951.7 filed 18 Dec. 2008, each of which are incorporated herein by reference.

BACKGROUND OF THE INVENTION

The invention relates to the field of papermaking. More in particular, the invention relates to the use of a novel dry strength agent in the wet-end of the papermaking process.

Traditionally, cationic starches are applied as dry strength agents in the wet-end of the paper production process. Due to the presence of anionic groups on the cellulose fibres and fillers, cationic starch binds to the fibres and fillers. This electrostatic interaction also gives an improvement in the retention on the sieve of both the cellulose fibres and the fillers in the paper sheet. Beside as dry strength agent and retention support cationic wet-end starches are also used for alkenyl succinic anhydride (ASA) emulsification in the wet-end.

A serious drawback of the use of cationic starch is its limitation of the amount of cationic starch that can be used. Addition of cationic starch to the fibres gives rise to the neutralisation of the anionic charge on the cellulose fibres and fillers and eventually overcharging leading to an overall cationic charge. This has to be avoided because overcharging results in a dramatic reduction in wet-end performance, overall retention and formation, of the paper machine.

In the paper industry there is an increasing demand for dry strength. This demand is a result of the following trends: use of more cheap and/or secondary cellulose fibres, the increase in filler content in the paper sheet and the use of a pre-metering size press. Therefore, there exists an increasing need for new wet-end starches which allows for increasing the addition levels in the wet-end without the risk of overcharging the cellulose fibres and fillers.

In accordance with the invention it has surprisingly been found that the use of a hydrophobic starch as dry strength agent avoids neutralisation of the anionic charges on both cellulose fibres and fillers, while having a strong binding affinity to the cellulose fibres and fillers, thereby providing the required contribution to paper strength.

The use of a hydrophobic starch as dry strength agent does not have any substantial influence on the overall charge balance in the wet-end of the papermaking process. It can therefore be used in higher amounts than conventional dry strength agents without disturbing the wet-end performance, overall retention and formation at the paper machine.

Hydrophobic groups have a low affinity for an aqueous environment. When added to water, hydrophobic groups show a strong tendency to avoid contact with water molecules. In the presence of solid particles, like cellulose fibres and the filler materials used in papermaking, it has been found that the hydrophobic starch tends to adsorb to these particles, rather than staying in the aqueous phase. Without wishing to be bound by theory, it is postulated that this behaviour explains the binding capacity and performance of the hydrophobic starch as dry strength agent in the wet-end of papermaking.

The international patent application WO 99/55964 discloses a process for the production of paper from a suspension containing cellulosic fibres which comprises adding to the suspension a drainage and retention aid comprising a cationic or amphoteric polysaccharide, forming and dewatering the suspension on a wire, wherein the cationic polysaccharide has a hydrophobic group. The degree of substitution (DS) of anionic groups for the polysaccharide is from 0 to 0.2. However, the polysaccharide is also substituted with cationic groups and the DS of cationic groups is from 0.01 to 0.5, preferably from 0.025 to 0.2. The DS of cationic groups is always higher than that of anionic groups, making these polysaccharides overall cationically charged. Therefore, the binding mechanism to the fibres is still in accordance with the charge interaction mechanism.

The international patent application WO 2004/031478 discloses a cationised polysaccharide product comprising a polysaccharide having at least one first substituent having an aromatic group and at least one second substituent having no aromatic group, wherein the first substituent and the second substituent are present in a molar ratio in the range of 10:1 to 1:10. Also disclosed is a process for making paper wherein the cationised polysaccharide is added to an aqueous suspension containing cellulosic fibres.

The hydrophobicity of aliphatic groups is dependent on the number of carbon atoms. Compared to aromatic groups with the same number of carbon atoms, the aliphatic carbon chain is more hydrophobic. In accordance with the invention it has surprisingly been found that hydrophobic anionic starches bearing an aliphatic carbon chain, with an overall negative charge density between 0 and −0.09 μeq/mg exhibit a high affinity for solid particles in the wet-end. Thus, in accordance with the invention there is a preference for hydrophobic starches having an overall negative charge density between 0 and −0.09 μeq/mg, and a greater preference for such starches having an overall negative charge density between −0.005 and −0.07 μeq/mg.

The dry strength agent in accordance with the invention is a hydrophobic starch which may, in principle, be derived from any botanical source. Both root or tuber starches, such as cassava or potato starch, and cereal and fruit starches, such as maize, rice, wheat or barley starches can be used. Legume starches, such as pea or bean starches, can also be used. In a preferred embodiment, the starch is a root or tuber starch, more preferably potato or cassava starch.

Natural starches typically have a more or less fixed ratio of the two components of starch, amylose and amylopectin. Of some starches, such as maize or rice starch, a natural occurring variety exists which contains essentially only amylopectin. These starches, which are normally called waxy starches, can also be used. Of other starches, such as potato or cassava starch, there are genetically modified or mutant varieties, which also essentially only contain amylopectin. It will be understood that the use of these varieties, typically comprising more than 80 wt. %, preferably more than 95 wt. %, based on dry weight of the starch, of amylopectin, is also within the scope of the invention. Finally, also starch varieties that are high in amylose, such as high amylose potato starch, can be used for the preparation of a dry strength agent according to the invention. In accordance with the invention, starches of all amylose to amylopectin ratios may be used. However, it is preferred that a starch is used having a regular or increased amylopectin content.

The starch for making a hydrophobic starch in accordance with the invention is preferably a native starch. However, if desired, the molecular weight of the starch may be decreased or increased by any method known in the art, such as acidic degradation or oxidation, prior to or simultaneous with the introduction of the hydrophobic group.

DESCRIPTION OF THE INVENTION

In accordance with the invention, a hydrophobic starch is a starch that has been modified by etherification, esterification or amidation with a hydrophobic reagent comprising an aliphatic and/or aromatic group and has from 4-24 carbon atoms, preferably from 7-20 carbon atoms, more preferably 12 carbon atoms. It is preferred that the hydrophobic reagent is based on an aliphatic group.

The hydrophobic starch may be prepared by attaching a hydrophobic substituent to the starch by an ether, ester or amide group. When the hydrophobic group is attached to the starch via an ether linkage, the hydrophobic reagent preferably comprises a halide, halohydrin, epoxide or glycidyl group as reactive site. The alkyl chain of the agent can vary from 4-24 carbon atoms, preferably from 7-20 carbon atoms. Suitable examples of hydrophobic reagents to provide an ether linkage are cetyl bromide, lauryl bromide, butylene oxide, epoxidized soybean fatty alcohols, epoxydized linseed fatty alcohols, allyl glycidyl ether, propyl glycidyl ether, butyl glycidyl ether, decane glycidyl ether, lauryl glycidyl ether, lauryl phenyl glycidyl ether, myristoyl glycidyl ether, cetyl glycidyl ether, palmityl glycidyl ether, stearyl glycidyl ether, linolyl glycidyl ether and mixtures thereof. Other etherification agents which may be used to react with starch in accordance with the invention are alkyl halides containing at least four carbon atoms, such as 1-bromodecane, 10-bromo-1-decanol, and 1-bromododecane.

In a preferred embodiment a charged hydrophobic group is introduced. A hydrophobic cationic group can be attached via an ether linkage by reaction of the starch with a reagent comprising a quaternary ammonium group, for example a 1-chloro-2-hydroxypropyltrialkyl ammonium salt or a glycidyltrialkyl ammonium salt. The alkyl chains of this quaternary ammonium group can vary from 1-24 carbon atoms, preferably from 7-20 carbon atoms, wherein at least one of the alkyl chains of the quaternary ammonium group comprises 4-24 carbon atoms. Preferably, the other alkyl chains have less than 7 carbon atoms. For example (3-chloro-2-hydroxypropyl)dimethyl dodecylammonium salt, 1-chloro-2-hydroxypropyldimethyllauryl ammonium salt, 1-chloro-2-hydroxypropyldimethylmyristoyl ammonium salt, 1-chloro-2-hydroxypropyldimethylcetyl, 1-chloro-2-hydroxypropyldimethylstearyl, glycidyldimethyllauryl ammonium salt, glycidyldimethylmyristoyl ammonium salt, glycidyldimethylcetyl ammonium salt, glycidyldimethylstearyl ammonium salt, dialkylaminoethyl halide, or mixtures of the above can be applied as hydrophobic cationization reagent. A hydrophobic cationic group may be introduced by reaction with tertiary ammonium groups such as chloroethyldialkylamine hydrogen chloride salt. The alkyl chain of this tertiary ammonium group may vary from 1 to 24 carbon atoms. The reaction for introducing the hydrophobic cationic group may be performed analogous to the procedure disclosed in EP-A-0 189 935. A hydrophobic anionic group can be attached applying a 2-chloro-aminodialkyl acid as reagent, for instance analogous to the procedure disclosed in EP-A-0 689 829.

When the hydrophobic group is attached to the starch via an ester linkage, several kinds of reagents, such as alkyl anhydrides can be applied. The alkyl chain can vary from 4-24 carbons, preferably from 7-20 carbons. Especially, mixed anhydrides as octanoic acetic anhydride, decanoic acetic anhydride, lauroyl acetic anhydride, myristoyl acetic anhydride are suitable alkyl anhydrides.

In a preferred embodiment, hydrophobic anionic groups may be attached to the starch. This may be accomplished by reaction of the specific starch with an alkyl succinic anhydride or alkenyl succinic anhydride. Alkyl succinic anhydrides are preferred. The alkyl chain can vary from 4-24 carbons, preferably from 7-20 carbons. Octenyl succinic anhydride, nonyl succinic anhydride, decyl succinic anhydride, dodecenyl succinic anhydride are most commonly applied. The procedure in accordance with this embodiment may be performed analogous to the procedures disclosed in U.S. Pat. No. 5,776,476.

For the preparation of a hydrophobic group linked to carboxymethyl starch by an amide group the procedure as described in WO-A-94/24169 can analogously be applied. Examples of suitable reagents for introduction of an amide group include fatty amines comprising saturated or unsaturated hydrocarbon groups having from 8 to 30 carbon atoms. Branched hydrocarbon groups are not excluded, but linear chains are preferred. Preferably, the fatty radical originates from a $C_{12}$ to $C_{24}$ fatty amine. Particularly favorable results are obtained if the fatty amine is selected from the group consisting of n-dodecylamine, n-hexadecylamine, n-octadecylamine, cocoamine, tallowamine, hydrogenated N-tallow-1,3-diaminopropane, N-hydrogenated tallow-1,3-diaminopropane, and N-oleyl-1,3-diaminopropane. Such fatty amines are known under the trade names Armeen and Duomeen (AKZO Chemicals).

The degree of hydrophobic substitution, i.e. DS, defined as the average number of moles of hydrophobic substituents per mole glucose units, achieved in a process according to the invention, may vary depending upon the presence of other substituents in the starch prior to the hydrophobation, the type of hydrophobic reagent used, and the envisage application of the product. According to the invention the DS is from 0.0001 to about 0.01, more preferably from 0.002 to 0.008. It is surprising to note that even a very small DS leads to a relatively large effect.

The hydrophobation of the starch may be performed under semi-dry reaction conditions, in suspension (water or organic solvent), in aqueous solution (dispersion), or during the gelatinization of the starch granules. It is also possible to perform the hydrophobation in an extruder at increased temperature and pressure. According to the latter embodiment, it is possible to perform the reaction continuously. The moisture content is preferably smaller than 25% when the reaction is carried out in an extruder.

Preferably, water is used as a solvent when the reaction is performed in suspension. When the hydrophobic reagent has a low solubility in water, combinations of water and suitable water mixable organic solvents may be employed. Suitable organic solvents include, but are not limited to, methanol, ethanol, i-propanol, n-propanol, t-butanol, sec-butanol, methylethylketone, tetrahydrofuran, dioxan, and acetone.

The reaction in aqueous solution is preferably performed using a reaction mixture comprising more than 20 wt. % of the starch or derivative thereof and less than 80 wt. % of the solvent. More preferably, the starch content in the reaction mixture lies between 20 and 40 wt. %, whereas the solvent content preferably lies between 80 and 60 wt. %. An autoclave in combination with a dryer (drum dryer; spray dryer) or an extruder is preferably used as a reaction vessel. The reaction is further performed under conditions which are well-known for analogous reactions. The pH lies preferably between 7 and 13.

Preferably, the hydrophobic starch is prepared in the presence of a caustic catalyst, such as an alkali metal hydroxide or the like material. In accordance with specific embodiments, the caustic catalyst is used in such amounts that it is in fact present as a reagent.

Further, it has been found that the reaction for preparing a hydrophobic starch can be accelerated by the presence of one or more surfactants in the reaction mixture. Suitable surfactants are characterized by the ability to facilitate bringing the hydrophobic reagent in contact with the hydrophilic starch, so reaction can take place (phase-transfer catalysis). In accordance with this embodiment, the reaction is preferably performed while the reaction mixture is stirred. Surfactants can be applied in any of the above mentioned reaction systems. The surfactants which may be used include nonionics, anionics, cationics or amphoterics, singly or in combination provided they are compatible with the other components of the reaction system and they are capable to facilitate bringing the hydrophobic reagent in contact with the hydrophilic starch. Examples of suitable surfactants are higher fatty alcohol sulfates, such as a sodium or potassium sulfate of an alcohol having from 8 to 18 carbon atoms, alkylphenoxypolyethoxyethanols, such as octylphenoxypolyethoxyethanols, alkyltrimethylammonium halides and alkyltributylammonium hydroxides, such as tetramethylammonium hydroxide and cetyltrimethylammonium bromide, alkyl acids, such as stearic acid, an ethylene oxide condensate of a long-chain alcohol, such as lauryl, or cetyl alcohol, polyoxyethylene sorbitan stearate, and many others. Preferably, the surfactant comprises a branched alkyl chain or multiple alkyl chains. The amounts wherein the surfactants are used may vary between 0.1 and 10 wt. %, based on dry substance of starch.

In a preferred embodiment, the hydrophobic starch is also crosslinked. Crosslinking may be performed in any known manner. Examples of suitable manners for obtaining the desired derivatives are for instance disclosed in "Modified Starches: Properties and Uses", O. B. Wurzburg, CRC Press Inc., 1987. In a crosslinking reaction, the hydrophobic starch is treated with a reagent, a crosslinking agent, having two or more reactive groups. The crosslink agent is preferably attached to the starch via ester and/or ether linkages. Examples of suitable reactive groups are anhydride, halogen, halohydrin, epoxide or glycidyl groups, or combinations thereof. Epichlorohydrin, sodium trimetaphosphate, phosphorous oxychloride, phosphate salts, chloroacetic acid, adipic anhydride, dichloroacetic acid, and combinations thereof have been found to be suitable for use as crosslinking agents. It is preferred that the crosslinking agent is added to the reaction mixture in which the hydrophobation reaction is carried out. The crosslinking reaction may be carried out before, simultaneous with, or after the reaction that introduces the hydrophobic group. It is preferred that both reactions are carried out simultaneous.

The hydrophobic starch may be used as dry strength agent in the wet-end of papermaking in an amount that will depend on the kind of pulp that is used, the working conditions and the desired paper properties. Preferably, 0.05 to 10 wt. % and more preferably 0.1 to 3 wt. % of hydrophobic starch, dry substance, calculated on the paper pulp, dry substance, is used.

The hydrophobic starch is preferably first gelatinized in water. The resultant starch solution, optionally after further dilution, is added to the pulp mass. It is also possible, however, to mix pre-gelatinized hydrophobic starch with the pulp mass, either as dry product or after dissolution in water).

It is contemplated that the hydrophobic starch is used in combination with other dry strength agents, such as conventional cationic or anionic starches. In the case of anionic starches, it may be desired to also use fixative, as is described in WO-A-93/01353 and WO-A-96/05373. For an optimal binding of non-hydrophobic anionic starches to fibers and fillers in the wet-end, as described in the prior art, the use of a cationic fixative is necessary. Surprisingly it has been found that for the use of a hydrophobic starch as dry strength agent according to the invention, a fixative need not be used as it binds to the fibres and fillers.

The hydrophobic starch can be added at any point in the papermaking process, although it will generally be added in the wet-end, i.e. before formation of the paper sheet on the sieve. For example, it can be added to the pulp while it is disposed in the head box, the Hollander, the hydropulper or the dusting box.

The pulp used for the papermaking will generally be an aqueous suspension of cellulosic fibres, synthetic fibres, or combinations thereof, optionally containing fillers. Among the cellulosic materials which may be used are bleached and unbleached sulfate (kraft), bleached and unbleached sulfite, bleached and unbleached soda, neutral sulfite, semi-chemical, thermomechanical, chemithermomechanical, chemi-ground wood, ground wood, recycle or any combination of these fibers. Fibers of the viscose rayon, regenerated cellulose, cotton and the like may also be used if desired.

Any desired inert mineral fillers may be added to the pulp which is to be utilized with the dry strength agent according to the invention. Such materials include clay, titanium dioxide, talc, calcium carbonate, calcium sulfate and diatomaceous earths. Rosin may also be present, if desired.

Other additives commonly introduced into paper may be added to the pulp or furnish, for example, dyes, pigments, sizing additives, alum, retention aids, etc.

In addition to the selected dry strength agent and other components that may be included in the papermaking system as described above, colloidal inorganic minerals may be added to the system to form an alkaline microparticle system. Such microparticle systems include colloidal silica, bentonite, or the like and may be incorporated into the system in amounts of at least 0.001% and more particularly from about 0.01 to 1% by weight based on the weight of dry pulp. Further description of such microparticle inorganic materials may be found in U.S. Pat. No. 4,388,150, U.S. Pat. No. 4,643,801, U.S. Pat. No. 4,753,710 and U.S. Pat. No. 4,913,775.

The amount of the dry strength agent that may be added to the wet-end or paper pulp will be an effective amount to provide the desired property (e.g. strength, drainage or retention). Typically an amount from about 0.05 to 5% of the starch derivative, most suitably from about 0.1 to 2%, by weight based on the dry weight of the pulp will be used.

One embodiment of this invention is that the dry strength can be added directly, i.e. in dry form, to the papermaking system at any convenient place, where elevated temperatures exist, before the formation of the sheet. Examples can include, but are not limited to, the head box, pulper, machine chest, blend chest, stuff box or white water tray. Alternatively, the dry strength agent can be dispersed into water before being added to the papermaking process. Typically this is accomplished by slurrying the granular starch product at about 0.1 to 30 percent solids into water and adding directly to the machine prior to the head box. The slurry may be heated between about 40 and 100° C., particularly between 60 and 70° C., or the starches can be added to preheated water from any source. It is advantageous to use recycled water from common processes in the papermill, such sources could include the whitewater, or other equipment or processes that produce warm/hot water as a by-product of their operation. While it is ideal to disperse these starches into water at less than 100° C., it would be obvious to one skilled in the art to cook these starches at typical elevated temperatures. Examples of the cooking techniques that could be used are jet cooking, batch cooking, steam injection, pressure-cooking and the like.

When prepared as described above, the dry strength agent according to the invention provide the papermaker many advantages over what is currently available. Being easy to prepare and requiring less temperature to disperse the granular starch results in energy and equipment savings and reduced worker exposure to high temperature liquids and hot equipment. In addition to the typical benefits obtained from traditional starches, the derivatives of this invention provide better resistance to the shear of today's high speed machines and pumps. Improved strength, particularly in high conductivity or partially closed systems, affords papermakers the ability to prepare sheets lighter in weight and thus save on pulp costs.

The invention will now be elucidated by the following, non-restrictive examples.

EXAMPLES

Example 1

Hydrophobic starch derivatives were prepared by reacting potato starch with (3-chloro-2-hydroxypropyl)dimethyl dodecylammonium chloride (QUAB 342, QUAB Chemicals) according to the general procedure described in EP 0 603 727. In some cases, sodium trimethaphosphate was added (250 mg/kg), to achieve a simultaneous crosslinking. The degree of substitution of QUAB 342 was 0.004, 0.006 and 0.008.

The thus obtained dry strength agents were dissolved in water with live stream at 10% concentration. Brookfield viscosity was measured in 5% concentration at 50° C. (60 rpm). The starch solutions were diluted to 1%. The charge density was measured from a diluted solution using minusil as carrier, and 1 mM methyl glycol chitosan as titrant with a Malvern Zetasizer 3000.

The adsorption of the starches on to solid pulp components was studied as follows. To a pulp 1.6% starch (dry-on-dry) was added and after 60 second the pulp was filtered. For comparison also native potato starch and a standard cationic wet-end starch, Amylofax PW (DS chlorohydroxypropyl trimethyl ammonium chloride of 0.035), were studied. The starch adsorptions were determined by measuring the amount of non-adsorbed starch in the filtrate. The pulp was a birch sulphate pulp beaten to 32° SR (measured at 21° C.) at a consistency of 2% in tap-water using a Hollander. After beating the pulp was diluted to a consistency of 1% with tap-water. The conductivity was set to 1500 μS/cm by the addition of NaCl. The amount of starch in the filtrate was determined with an enzymatic method. In accordance with this method, starch is first converted to glucose with α-amylase and an aminoglucosidase.

Subsequently, the amount of glucose is determined spectroscopically using a hexokinase test method (Raisio diagnostics). The amount of starch is calculated from the obtained amount of glucose using a correction factor for incomplete conversion of the starch into glucose by the enzymes. This correction factor depends on the type of starch and was determined separately by standard methods. The Zeta potential of the pulp was measured with the Malvern Zetasizer 3000.

An overview of the starch adsorptions for the starches is given in Table 1.

TABLE 1

| Starch | DS QUAB 342 (mol/mol) | Cross-linker | Brook-field (mPa · s) | Charge density (μeq/mg) | Starch adsorp-tion (%) | Zeta potential (mV) |
|---|---|---|---|---|---|---|
| Potato starch | None | None | 440 | −0.07 | 32 | −3.3 |

TABLE 1-continued

| Starch | DS QUAB 342 (mol/mol) | Cross-linker | Brook-field (mPa · s) | Charge density (μeq/mg) | Starch adsorp-tion (%) | Zeta potential (mV) |
|---|---|---|---|---|---|---|
| QUAB 0.004 | 0.004 | None | 420 | −0.04 | 56 | −3.2 |
| QUAB 0.006 | 0.006 | None | 600 | −0.03 | 68 | −3.1 |
| QUAB 0.008 | 0.008 | None | 570 | −0.005 | 77 | −2.9 |
| QUAB 0.004C | 0.004 | Yes | 1500 | −0.04 | 83 | −3.5 |
| QUAB 0.006C | 0.006 | Yes | 1900 | −0.02 | 89 | −3.6 |
| QUAB 0.008C | 0.008 | Yes | 1550 | −0.002 | 93 | −3.2 |
| Amylofax PW | None | None | 380 | +0.31 | 91 | +2.7 |

From these results can be seen that all the hydrophobic QUAB derivatives exhibit an overall negative charge density. A regular cationic wet-end starch, like Amylofax PW, exhibits a positive charge density. The starch adsorption is low for native potato starch. By the introduction of hydrophobic groups the starch adsorption is increased considerably and with the combination of hydrophobation and crosslinking the adsorption is further improved. With a standard cationic wet-end starch like Amylofax PW also high starch adsorption is achieved at 1.6% addition level, but in this case the Zeta potential of the fibres has changed from negative to positive. With the new hydrophobic wet-end starches the Zeta potential is still negative at addition levels of 1.6%.

Example 2

Mixtures of the hydrophobic starch derivatives describe in example 1 and Amylofax PW (ratio 1:2) were prepared and tested according to the procedure described in example 1. An overview of the starch adsorptions is given in table 2.

TABLE 2

| Starch mixtures (2:1) | DS QUAB 342 (mol/mol) | Cross-linker | Brook-field (mPa · s) | Starch adsorp-tion (%) | Zeta potential (mV) |
|---|---|---|---|---|---|
| Amylofax PW/ native potato starch | None | None | 790 | 76 | −2.1 |
| Amylofax PW/ QUAB 0.004 | 0.004 | None | 590 | 84 | −0.5 |
| Amylofax PW/ QUAB 0.006 | 0.006 | None | 580 | 88 | −1.0 |
| Amylofax PW/ QUAB 0.008 | 0.008 | None | 570 | 91 | −2.2 |
| Amylofax PW/ QUAB 0.004C | 0.004 | Yes | 815 | 95 | −0.7 |
| Amylofax PW/ QUAB 0.006C | 0.006 | Yes | 700 | 96 | −1.2 |
| Amylofax PW/ QUAB 0.008C | 0.008 | Yes | 650 | 97 | −0.8 |
| Amylofax PW | None | None | 380 | 91 | +2.7 |

From these results can be seen that also in combination with traditional cationic starches the hydrophobic starches according to the invention exhibit a good starch adsorption performances at 1.6% dosage without overcharging the cellulose fibers.

Example 3

Hydrophobic starch derivatives were prepared by reacting potato starch with N-(3-chloro-2-hydroxypropyl)-N-benzyl- N,N-dimethylammonium chloride (Benzyl reagent) according to the procedure described in Example 1. In some cases, sodium trimethaphosphate was added (250 mg/kg), to achieve a simultaneous crosslinking. The degree of substitution of Benzyl reagent was 0.004, 0.006 and 0.008. These hydrophobic starch derivatives were tested according to the procedure described in example 2 (2:1 mixture of Amylofax PW and Benzyl derivative). An overview of the starch adsorptions for the starches is given in table 3.

TABLE 3

| Starch | DS Benzyl (mol/mol) | Cross-linker | Charge density (μeq/mg) | Brook-field (mPa · s) | Starch mixtures (2:1) | Starch adsorp-tion (%) |
|---|---|---|---|---|---|---|
| Benzyl 0.004 | 0.004 | None | −0.06 | 390 | Amylofax PW/Benzyl 0.004 | 76 |
| Benzyl 0.006 | 0.006 | None | −0.02 | 360 | Amylofax PW/Benzyl 0.006 | 76 |
| Benzyl 0.008 | 0.008 | None | −0.01 | 360 | Amylofax PW/Benzyl 0.008 | 77 |
| Benzyl 0.004C | 0.004 | Yes | −0.02 | 2050 | Amylofax PW/Benzyl 0.004C | 92 |
| Benzyl 0.006C | 0.006 | Yes | −0.02 | 1700 | Amylofax PW/Benzyl 0.006C | 90 |
| Benzyl 0.008C | 0.008 | Yes | −0.01 | 1600 | Amylofax PW/Benzyl 0.008C | 94 |

From these results can be seen that the starch adsorption is not dependent on the DS Benzyl. Therefore the benzyl group (C7) is the lower limit for the hydrophobic interaction according to the invention.

Example 4

Hydrophobic starch derivatives were prepared by reacting potato starch with octenyl succinic anhydride (OSA) according to the general procedure described in EP 1141030 B1. In some cases, sodium trimethaphosphate was added (250 mg/kg), to achieve a simultaneous crosslinking. The degree of substitution of octenyl succinic anhydride was 0.004, 0.006 and 0.008. These hydrophobic starch derivatives were tested according to the procedure described in example 1. An overview of the starch adsorptions for the starches is given in Table 4.

TABLE 4

| Starch | OSA (mol/mol) | Cross-linker | Brook-field (mPa · s) | Charge density (μeq/mg) | Starch adsorp-tion (%) | Zeta po-tential (mV) |
|---|---|---|---|---|---|---|
| OSA 0.004 | 0.004 | None | 430 | −0.09 | 28 | −4.8 |
| OSA 0.006 | 0.006 | None | 560 | −0.10 | 30 | −4.9 |

TABLE 4-continued

| Starch | OSA (mol/mol) | Cross-linker | Brook-field (mPa · s) | Charge density (μeq/mg) | Starch adsorp-tion (%) | Zeta po-tential (mV) |
|---|---|---|---|---|---|---|
| OSA 0.008 | 0.008 | None | 490 | −0.12 | 34 | −4.9 |
| OSA 0.004C | 0.004 | Yes | 1610 | −0.09 | 67 | −5.0 |
| OSA 0.006C | 0.006 | Yes | 1650 | −0.10 | 68 | −4.5 |
| OSA 0.008C | 0.008 | Yes | 2200 | −0.11 | 72 | −4.8 |

From these results can be seen that a charge density below −0.09 μeq/mg is most preferable for hydrophobic interaction according to the invention.

The invention claimed is:

1. A process for making paper comprising providing an aqueous suspension of cellulosic fibres, synthetic fibres, or combinations thereof and, optionally, fillers, adding to the suspension a dry strength agent, wherein the dry strength agent is a hydrophobic starch that has been modified by etherification, esterification or amidation with a hydrophobic reagent comprising an aliphatic and/or aromatic group having from 7-20 carbon atoms, such that the degree of substitution (DS) of the starch is from 0.0001 to 0.01, wherein, when the hydrophobic starch has been modified by etherification, the hydrophobic reagent comprises a quaternary ammonium group and wherein the hydrophobic starch has an overall charge density between 0 and −0.09 μeq/mg, and forming and dewatering the suspension on a wire to obtain a paper sheet.

2. A process according to claim 1, wherein the degree of substitution is from 0.002 to 0.008.

3. A process according to claim 1, wherein the hydrophobic reagent is an aliphatic group having from 7-20 carbon atoms.

4. A process according to claim 3, wherein the hydrophobic reagent is a (3-chloro-2-hydroxypropyl)dimethyl dodecylammonium salt.

5. A process according to claim 3, wherein the hydrophobic reagent is (3-chloro-2-hydroxypropyl)dimethyl dodecylammonium chloride.

6. A process according to claim 1, wherein the starch is a root or tuber starch.

7. A process according to claim 6, wherein the starch is potato starch.

8. A process according to claim 1, wherein the hydrophobic starch is crosslinked.

9. A process according to claim 8, wherein the hydrophobic starch is crosslinked using sodium trimetaphosphate.

10. A process according to claim 1, wherein the hydrophobic reagent comprises an aliphatic group having 12 carbon atoms.

11. A process according to claim 1, wherein the hydrophobic starch has an overall negative charge density between −0.005 and −0.07 μeq/mg.

* * * * *

UNITED STATES PATENT AND TRADEMARK OFFICE

CERTIFICATE OF CORRECTION

PATENT NO. : 8,585,865 B2
APPLICATION NO. : 13/120469
DATED : November 19, 2013
INVENTOR(S) : Thomas Albert Wielema It is certified that error appears in the above-identified patent and that said Letters Patent is hereby corrected as shown below:

ON THE TITLE PAGE:

ITEM (73) ASSIGNEE:

Now reads: "Cooperative A VEBE U.A., Foxhold (NL)"

Should read: -- Cooperative A VEBE U.A., Foxhol (NL) --

Signed and Sealed this
Eleventh Day of March, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,585,865 B2
APPLICATION NO. : 13/120469
DATED : November 19, 2013
INVENTOR(S) : Thomas Albert Wielema It is certified that error appears in the above-identified patent and that said Letters Patent is hereby corrected as shown below:

ON THE TITLE PAGE:

ITEM (73) ASSIGNEE:

Now reads: "Cooperative A VEBE U.A., Foxhold (NL)"

Should read: -- Coöperatie AVEBE U.A., Foxhol (NL) --

This certificate supersedes the Certificate of Correction issued March 11, 2014.

Signed and Sealed this
Third Day of June, 2014

Michelle K. Lee

Michelle K. Lee
*Deputy Director of the United States Patent and Trademark Office*